US009151137B2

(12) United States Patent
Daigle

(10) Patent No.: US 9,151,137 B2
(45) Date of Patent: Oct. 6, 2015

(54) CONFIGURATIONS AND METHODS FOR IMPROVED SUBSEA PRODUCTION CONTROL

(75) Inventor: Timothy Paul Daigle, Pearland, TX (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 611 days.

(21) Appl. No.: 13/133,466

(22) PCT Filed: Dec. 16, 2009

(86) PCT No.: PCT/US2009/068227

§ 371 (c)(1), (2), (4) Date: Jun. 28, 2011

(87) PCT Pub. No.: WO2010/077932

PCT Pub. Date: Jul. 8, 2010

(65) Prior Publication Data

US 2011/0259596 A1 Oct. 27, 2011

Related U.S. Application Data

(60) Provisional application No. 61/138,257, filed on Dec. 17, 2008.

(51) Int. Cl.
*E21B 7/12* (2006.01)
*E21B 34/04* (2006.01)

(52) U.S. Cl.
CPC ..... *E21B 34/04* (2013.01)

(58) Field of Classification Search
USPC ..... 166/344, 363, 368, 250.01, 250.15, 166/264, 369, 373, 91.1, 97.1; 137/2; 702/12, 13
See application file for complete search history.

(56) References Cited

U.S. PATENT DOCUMENTS

| | | | | |
|---|---|---|---|---|
| 4,721,158 | A * | 1/1988 | Merritt, Jr. et al. | 166/250.01 |
| 5,135,684 | A * | 8/1992 | Mohn et al. | 261/76 |
| 5,544,672 | A * | 8/1996 | Payne et al. | 137/1 |
| 5,971,077 | A | 10/1999 | Lilley | |
| 6,390,114 | B1 * | 5/2002 | Haandrikman et al. | 137/2 |
| 6,604,581 | B2 | 8/2003 | Moake et al. | |
| 6,813,962 | B2 * | 11/2004 | Gysling et al. | 73/861.26 |
| 7,261,162 | B2 * | 8/2007 | Deans et al. | 166/336 |
| 7,434,621 | B2 | 10/2008 | Aarvik et al. | |
| 7,569,097 | B2 * | 8/2009 | Campen et al. | 95/243 |
| 2009/0149969 | A1 * | 6/2009 | Slupphaug et al. | 700/42 |
| 2009/0223672 | A1 * | 9/2009 | Naik | 166/344 |
| 2010/0132800 | A1 * | 6/2010 | Jamaluddin et al. | 137/2 |
| 2010/0145634 | A1 * | 6/2010 | Pinguet et al. | 702/45 |
| 2012/0165995 | A1 * | 6/2012 | Crawley et al. | 700/282 |
| 2012/0216625 | A1 * | 8/2012 | Bruno et al. | 73/861.04 |

FOREIGN PATENT DOCUMENTS

| | | |
|---|---|---|
| WO | 02/46577 | 6/2002 |
| WO | 2008/045381 | 4/2008 |
| WO | 2009/131462 | 10/2009 |

* cited by examiner

*Primary Examiner* — Matthew Buck
*Assistant Examiner* — Aaron Lembo
(74) *Attorney, Agent, or Firm* — Fish & Tsang LLP

(57) ABSTRACT

Systems and methods of production control are contemplated in which one or more multiphase flow meters are operationally coupled to a production conduit to provide flow and compositional information for the fluid in the production conduit. Data from the multiphase flow meter are then provided to a control system that uses the data to control operation of one or more choke valves of one or more well heads that are fluidly coupled to the production conduit.

17 Claims, No Drawings

CONFIGURATIONS AND METHODS FOR IMPROVED SUBSEA PRODUCTION CONTROL

This application claims priority to our U.S. provisional application Ser. No. 61/138,257, which was filed Dec. 17, 2008, and which is incorporated by reference herein.

FIELD OF THE INVENTION

The field of the invention is systems and methods of controlling a choke valve using data from a multiphase flow meter, especially as it relates to subsea gas and oil production.

BACKGROUND OF THE INVENTION

Recent discoveries of High Pressure High Temperature (HPHT) oil and gas reserves in the Gulf of Mexico and the North Sea presented a significant challenge to subsea production technologies, and especially for production control. Most significantly, while the pressure differences at early production are estimated to be around 5000 psi or even higher, they are expected to substantially decrease over time. Such anticipated pressure gradient is difficult to manage in a safe and economic manner using currently known technology.

Therefore, reliable and adjustable subsea chokes are essential to address at least some of the problems associated with subsea production systems. In most currently known cases, a single subsea production choke is mounted on a subsea production tree, which is the main control device to adjust the flow rate from a well. Depending on the type of fluid conveyed (sour/sweet service) and pressure encountered, appropriate materials and configurations can be selected to improve performance and lifetime. Unfortunately, as the excess pressure in HPHT wells may be higher than 5000 psi across the production choke, rapid deterioration or even failure of the choke is likely due to high-velocity erosion at the choke trim (e.g., at very small opening, the flow area is relatively small and the fluids velocity is high. Moreover, changes from one phase to two phases further promote erosion, abrasion, and cavitation). To overcome at least some of these difficulties, dual-choke configurations may be implemented as described in our co-pending International application, published as WO 2008/045381, which is incorporated by reference herein. While such configurations and methods advantageously improve handling of relatively high pressure differentials and extend lifetime of the chokes, several drawbacks nevertheless remain.

For example, high wellhead pressures often require specific allocation measurements due to the vast network of production flow lines, risers, and subsea pipelines. For example, in the Gulf of Mexico, these systems are laid throughout valleys and drop offs, which tend to create void spots were produced water builds up. As a result, slug flows are common among these developments and often require large slug catcher systems. Furthermore, since effective choking is critical to apply HIPP (High Integrity Pressure Protection System) systems to the subsea pipeline, the choke is typically required to set the pressure at the inlet well below the design pressure to allow for flow transients and to provide sufficient time for a HIPPS valve to close in the event of a pressure increase due to blockage. As currently known choke valve systems fail to be responsive to fluid composition and changes thereof, pressure and flow control remains difficult in production, and especially subsea production.

To overcome at least some of the difficulties associated with flow control in subsea systems, various attempts have been made. For example, temperature and/or pressure can be measured at a point upstream of a location where a slug is generated as described in WO 02/46577. A dynamic feedback controller then calculates from the temperature or pressure measurement an appropriate setting for an output valve that is downstream of the temperature of pressure sensor. Alternatively, slug flow is controlled by a throttling valve in the flowline upstream of a gas-liquid separator and a differential pressure gauge that is used to measure the presence and the volume of the slug in the flowline (see e.g., U.S. Pat. No. 5,544,672). Similarly, U.S. Pat. No. 7,434,621 describes a system with a slug catcher or phase separator where a slug detector is located downstream of the point of slug initiation and upstream of the catcher or separator. Here, a computer unit is integrated into the flow line system and the downstream process to determine the type and volume of the slug and to predict its arrival time into the downstream process. While such systems will in some instances allow for at least partial automation of flow control, currently known systems tend to be unsuitable for use in HTHP wells and complex flow paths. Moreover, most known control systems to prevent or reduce slug flow suffer from significant lag between measurement and corrective action.

Therefore, while numerous configurations and methods of production control are known in the art, all or almost all of them suffer from one or more disadvantages. Thus, there is still a need to provide improved configurations and methods of production control, and particularly production well control.

SUMMARY OF THE INVENTION

The present invention is directed to systems and methods of production control, and especially subsea oil and gas production control where one or more multiphase flow meters are operationally coupled to a wellhead, production tree, production flow line, riser, and/or subsea pipeline. Flow and compositional information from the multiphase flow meter(s) are then fed to a control system that is configured to control operation of one or more choke valves that are fluidly coupled to the wellhead, production tree, production flow line, riser, and/or subsea pipeline.

In one aspect of the inventive subject matter, a method of controlling fluid flow of an oil/gas production conduit includes a step in which a first choke valve is fluidly coupled to a well head. In another step, flow of at least two phases of the fluid is measured in the production conduit (e.g., wellhead conduit, production tree conduit, production flow line, riser, and/or subsea pipeline) using a multiphase flow meter to so produce multiphase flow data. In yet another step, the multiphase flow data are then used in a control system to control operation of the choke valve to thereby regulate the fluid flow in the production conduit.

Most preferably, a second choke valve is in series with and downstream of the first choke valve, and operation of the second choke valve is also controlled by the control system. It is further generally preferred to measure flow of at least two phases of a second fluid in a second production conduit using a second multiphase flow meter to produce second multiphase flow data, and to use the second multiphase flow data in the control system to control operation of the first (and/or second) choke valve to thereby regulate the fluid flow in the production conduit. Alternatively, or additionally the second multiphase flow data may also be used in the control system to control operation of a third choke valve to thereby regulate flow of the second fluid in a second production conduit. Among other benefits, it should be appreciated that the control system in contemplated methods and systems can be configured to effectively reduce slug flow in the production conduit and/or to balance phase composition among a plurality of production conduits. While not limiting to the inventive subject matter, it is generally preferred that the well is a HPHT well and that the well head pressure is therefore at least 2500 psi, and more typically at least 3500 psi.

In another aspect of the inventive subject matter, a method of controlling fluid flow in a plurality of oil/gas production conduits that are fluidly coupled to each other will include the steps of fluidly coupling a first choke valve to a first well head, and fluidly coupling a second choke valve to a second well head; measuring flow of at least two phases of a fluid in a first and a second production conduit that are fluidly coupled to the first and second choke valves using first and second multiphase flow meters to produce first and second multiphase flow data; and using the first and second multiphase flow data in a control system to control operation of at least one of the first and second choke valves to thereby regulate fluid flow in the production conduits. Most preferably, a third and a fourth choke valve will be in series with and downstream of the first and second choke valve, respectively, wherein the fourth choke valve is in series with and downstream of the second choke valve, and wherein operation of at least the third and fourth choke valves is controlled by the control system.

Consequently, in a still further contemplated aspect of the inventive subject matter, the inventor also contemplates an oil/gas production tree that includes a first choke valve that is fluidly coupled between a well head and a production conduit. A multiphase flow meter is operationally coupled to the production conduit. Contemplated production trees will further be operationally coupled (e.g., electronically and/or hydraulically) to a control system that is configured to control the first choke valve using data obtained from the multiphase flow meter.

Most preferably, the tree includes a second choke valve is in series and downstream of the first choke valve, wherein the control system is further configured to allow control of the second choke valve. Where desired, a second multiphase flow meter may be coupled to a second production conduit, and the control system may be configured to receive data obtained from the multiphase flow meter. In such case, the second production conduit may be further coupled to a third choke valve, and the control system may then be configured to allow control of the first and the third choke valves.

Various objects, features, aspects and advantages of the present invention will become more apparent from the following detailed description of preferred embodiments of the invention.

DETAILED DESCRIPTION

The inventor discovered that production control, and particularly subsea oil and gas production control can be significantly improved in configurations and methods where one or more multiphase flow meters are employed as sensor(s) to provide in real time data that are representative of flow and phase composition in a production conduit (e.g., wellhead conduit, production tree conduit, production flow line, riser, and/or subsea pipeline). The so obtained data are then relayed to a control system that is configured to control operation of one or more choke valves that are fluidly coupled to the production conduit. In especially preferred aspects, a control unit will control operation of two or more choke valves, and/or receive data from two or more multiphase flow meters of two or more distinct production conduits.

Consequently, it should be appreciated that operation of one or more choke valves can be controlled in an automated manner using data from one or more multiphase flow meters to so allow for adjustment in flow and/or pressure differential in response to continuously or acutely changing production conditions, and especially to changes in overall product flow and/or composition.

In one especially preferred example, a method of controlling fluid flow of an oil/gas production conduit is contemplated in which a first choke valve is fluidly coupled to a well head (e.g., via coupling to the production tree associated with the well head). A multiphase flow meter is then used to measure the flow of at least two (and more typically three) phases of the fluid in the production conduit. While not limiting to the inventive subject matter, it is generally preferred that the measurement is continuous or taken at relatively short intervals (e.g., within seconds, and less preferably minutes). The measurements are typically provided as raw or compressed multiphase flow data, and transferred to one or more control systems, which then uses the multiphase flow data to control operation of the choke valve, thereby regulating the fluid flow in the production conduit. It is further generally preferred (and particularly where the well is a high-temperature high-pressure well) that a second choke valve in fluidly coupled to the production line. Most typically, the second choke valve is in series with and downstream of the first choke valve, and operation of the second choke valve is also controlled by the control system.

It should be noted that such configurations and methods advantageously allow for precise and typically real time control (e.g., measurement and corrective action less than 1 min, more typically less than 10 sec.) of production flow and pressure though a production conduit based on phase composition and flow, which has traditionally not been achievable using conventional sensor technology. Moreover, while contemplated configurations and methods may be implemented in a single choke valve solution, it is typically preferred that additional production conduits and multiphase meters are operationally coupled to the first choke valve and flow meter.

For example, it is contemplated to measure flow of at least two phases of a second fluid in a second production conduit using a second multiphase flow meter to produce second multiphase flow data. The so produced second multiphase flow data are then used in the control system (or second control system) to control operation of the choke valve to thereby regulate the fluid flow in the production conduit. Alternatively, or additionally, flow of at least two phases of a second fluid can be measured in a second production conduit using a second multiphase flow meter to produce second multiphase flow data, wherein the second multiphase flow data are used in the control system (or second control system) to control operation of a third choke valve to thereby regulate flow of the second fluid in a second production conduit. Thus, it should be appreciated that flow and phase compositional analysis of fluid in one conduit can be employed to control flow rate of another fluid in a second conduit, which is particularly advantageous in relatively complex gas and oil production fields having multiple and fluidly coupled production conduits.

In another preferred example, and especially where multiple production conduits are present in an oil or gas field, multiple multiphase flow meters can be employed under the control of one or more control systems. Consequently, it should be appreciated that such configurations and methods may also be employed to control fluid flow in a plurality of oil/gas production conduits (which are typically fluidly coupled to each other). In such case, it is typically preferred to fluidly couple a first choke valve to a first well head, and to fluidly couple a second choke valve to a second well head. Flow of at least two phases of a fluid in first and second production conduits is then measured using first and second multiphase flow meters to so produce corresponding first and second multiphase flow data. The first and second multiphase flow data are then used in a control system to control operation of the first and/or second choke valve to thereby regulate fluid flow in the production conduits. It is generally preferred in such configurations and methods that a third choke valve is in series with and downstream of the first choke valve, and that a fourth choke valve is in series with and downstream of the second choke valve, and that operation of at least the third and fourth choke valves is controlled by the control system.

Therefore, and viewed from a different perspective, it should be appreciated that the inventor also contemplates an oil/gas production tree (or other well head structure) that has a first choke valve that is fluidly coupled between a well head and a production conduit, and a multiphase flow meter is coupled to the production conduit and/or well head. Contemplated structures will further be operationally coupled to a control system that is configured to control the first choke valve using data obtained from the multiphase flow meter.

As already noted above, it is typically preferred that a second choke valve is fluidly coupled to and downstream of the first choke valve, and wherein the control system is further configured to allow control of the second choke valve. Similarly, it is still further preferred that a second multiphase flow meter is coupled to a second production conduit, wherein the control system is configured to receive data obtained from the multiphase flow meter. Additionally, or alternatively, the second production conduit may also be coupled to a third choke valve, and the control system may be configured to allow control of the first and the third choke valve.

With respect to the control system it is generally contemplated that the control system will receive data from at least one multiphase flow meter, and that the data are representative of the flow rate of a specific phase, and that the data are also representative of the phase composition of the fluid flow (e.g., indication of the fraction of at least two phases). Phases commonly encountered will include hydrocarbon liquids, hydrocarbon gases (and associated gases such as CO2, H2S, etc.), produced water, and sand.

Suitable control systems typically include one or more computers or other digital signal processing devices (e.g., programmable logic controller) that configured/programmed to enable the control system to receive data from one or more multiphase flow meters, and to provide directly or indirectly (e.g., via a hydraulic controller) control signals to one or more choke valves to so control operation of the choke valves. In a typical control system, a signal to the choke valve is generated upon a significant change in the phase composition of the fluid and/or significant change in flow rate of the fluid. In most typical embodiments, the control systems (e.g., UNIX or WINDOWS-based computer system) will employ empirical or theoretical models for proper flow dynamics and/or optimized production flow. For example, where a multiphase flow meter provides data that are indicative of a fractional increase in produced water, the control unit may be programmed or otherwise configured to send a control signal to the choke valve to reduce or even stop flow through the choke valve. On the other hand, where a multiphase flow meter of one conduit provides data that are indicative of a reduced overall flow rate, the control unit may be programmed or otherwise configured to send a control signal to a choke valve of another production conduit to increase flow through that choke valve.

With respect to the data transfer from the multiphase flow meter(s) and transmission of the control signal to the choke valve or intermediary device, it should be noted that all known manners of data transfer and/or transmission are deemed suitable for use herein. For example, suitable data transfer and/or transmission includes transfer via electric signal in a signal line, optical signal in an optical fiber, radio signal in one or more RF channels, etc. Of course, it should also be appreciated that contemplated configurations and methods may include more than one control systems that may operate individually or in an interconnected manner (e.g., two or more control systems are directly connected and/or be coordinated by a master control system). Therefore, it should be recognized that especially preferred control system will be configured to reduce slug flow in the production conduit(s) and/or balance phase composition among a plurality of production conduits. It is further contemplated that the control systems are preferably (but not necessarily) topside, and will receive data via data transmission channels as discussed above. The control signal(s) to the choke valve(s) are then relayed to the valves in conventional manner (e.g., electronically or hydraulically). There are numerous manners of controlling choke valves known in the art, and suitable manners are described in WO 99/47788, and U.S. Pat. Nos. 6,988,554, 6,575,237, and 6,567,013.

While it is generally preferred that the production conduits are production flow lines, risers, and/or subsea pipeline, other suitable production conduits include wellhead conduits, production tree conduits, and even slug catchers. Therefore, contemplated configurations and methods will typically be implemented at a well head, and most typically at a HPHT well head (e.g., having a fluid temperature of at least 200° F., more typically at least 250° F., and most typically at least 300° F., while the pressure differential between the fluid at the well head and the riser pressure will be at or above 2000 psi, more typically at or above 3500 psi, and most typically at or above 5000 psi).

With respect to the choke valve it is generally preferred that the choke valve is a subsea choke valve having a stem that is movable relative to a cylinder that has a plurality of openings or channels to so control the flow of the fluid. Thus, all known and commercially available subsea production chokes are deemed suitable for use herein, and the particular choice of a choke will predominantly depend on the production volume and pressure. Therefore, suitable production chokes include those in which disk stacks provide a tortuous path for the product, those in which a series of concentric sleeves define flow paths, and especially those designed to exhibit improved wear resistance over prolonged periods of operation. Depending on the particular choke valve and control system, the choke valve may be controlled via hydraulic, pneumatic, and electric actuation. Exemplary suitable subsea choke valves are described in WO 2007/074342, and in U.S. Pat. Nos. 4,589,493, 4,938,450, 5,018,703, 6,105,614, and 6,701,958.

While it is generally contemplated that the position of the first and second choke valves may vary considerably, it is preferred that the choke valves are mounted on devices that are located at the seabed. Thus, and among other options, it is contemplated that the first choke is mounted on a production tree. The second choke valve can then be mounted in series with the first choke valve on the same tree and downstream of the first choke valve to receive the stream that is reduced in pressure. Alternatively, the second choke valve may also be mounted in a position upstream of a riser, and most preferably upstream of a riser base. Therefore, suitable locations of the second choke valve include the production manifold, the flowline end template/manifold (FLEM). However, even more preferred locations include the production tree, a well jumper, a flowline jumper, and/or a pipeline end devices (e.g., pipeline end termination (PLET) or a pipeline end manifold (PLEM)). Among other advantages, it should be noted that contemplated systems and methods will optimize production, allow for better choke performance/durability, minimize use of large footprint equipment (e.g., slug catcher), and enhance production knowledge with real time data acquisition of yields. Moreover, contemplated systems and methods will also provide for a safer operation of high pressure equipment and more efficient well testing and diagnostics.

Similarly, the location of the multiphase flow meter may vary considerably and will typically at least in part depend on the type of production conduit, location and/or (subsea) terrain. However, it is generally preferred that the multiphase flow meter is proximal to the production tree, and most preferably coupled to the production tree. Alternatively, one or more multiphase flow meters may also be proximal or coupled to a flow manifold or riser base. There are numerous multiphase flow meters known in the art, and all of them are deemed suitable for use herein. However, particularly suitable multiphase flow meters include those suitable for operation in a subsea environment. For example, appropriate multiphase flow meters are described in U.S. Pat. App. No. 2006/0247869A1, WO 2009/049315A1, and U.S. Pat. No. 6,993,979B2.

While the specific arrangement of the chokes, the control system, and the multiphase flow meter is not critical to the inventive subject matter, it is generally preferred that the "Intelligent Choke" is designed with a "universal" footprint to so utilize any vendor meter design and any choking system. It should still further be appreciated that the "Intelligent Choke" will allow recognizing build up conditions in the production network and also allows taking appropriate counteraction to sweep a consistent flow through the production system to so optimize reservoir production, flow assurance, and reservoir performance. Consequently, it should be appreciated that contemplated systems and methods advantageously provide a dynamic and real-time response to data provided by one or more multiphase flow meters to so effectively monitor and control the choke performance. Viewed from a different perspective, contemplated control systems will provide a real time interface system to allow automation programming of the choking system, designed with sensitivity to the reliable operation of the chokes. As such, the use of a programmable control system can serve as the "brain" of the system. In addition, the use of a multiphase flow meter output to control the function of the chokes as an "Intelligent Choke" should provide maximum reservoir yields with increased reliability and safety.

It should also appreciated that the dynamic and real-time multiphase measurements linked to a dual subsea choke may be used to split the pressure to protect the chokes and enhance and optimize production from the reservoir. As the subsea multiphase flow meter provides the most dynamic measurement in a subsea metering, the so obtained data will provide the best sensing/feedback method to control a choke system. Such system will then reduce or even eliminate slug build-ups (e.g., from produced water in subsea production systems) and other flow irregularities to tailor a production profile of a reservoir to an optimum production curve which can be compared to PVT (pressure-volume-temperature) analysis and pre-identified saturation pressures and the specific well phase envelope.

These and other advantages improve economics (e.g., due to reduced intervention replacing chokes) and production time, and reduce risk to personnel and equipment during failure. It should be noted that contemplated configurations and methods will not require dedicated or new technology, but may employ currently proven choke technology. Moreover, it should be noted that use of sequential subsea production chokes, especially when operated at or in proximity to the wellhead will significantly facilitate operation throughout the entire production life of a subsea well.

Thus, specific embodiments and applications of methods of subsea production control have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of controlling fluid flow of an oil/gas production conduit, comprising:

fluidly coupling a first choke valve to a wellhead;

measuring flow of at least three phases of the fluid in the wellhead or a production tree using a multiphase flow meter to produce multiphase flow data;

measuring flow of at least two phases of a second fluid in a second production conduit using a second multiphase flow meter to produce second multiphase flow data;

wherein the three phases are selected form from the group consisting of a hydrocarbon liquid, a hydrocarbon gas, water, and sand;

wherein the multiphase flow data are representative of the flow rates of the respective phases in the fluid of the wellhead or production tree, and wherein the multiphase flow data are representative of a phase composition of the fluid of the wellhead or production tree; and using the multiphase flow data and the second multiphase flow data in a control system to control operation of the choke valve to thereby regulate the fluid flow in the production conduit.

2. The method of claim 1 further comprising a second choke valve, wherein the second choke valve is in series with and downstream of the first choke valve, and wherein of the second choke valve is also controlled by the control system.

3. The method of claim 1 wherein the production conduit is selected from the group consisting of a wellhead conduit, a production tree conduit, a production flow line, a riser, and a subsea pipeline.

4. The method of claim 1 further comprising a step of measuring flow of at least two phases of a second fluid in a second wellhead associated with a second well or a second production tree associated with the second well using the second multiphase flow meter to produce second multiphase flow data, and using the second multiphase flow data in the control system to control operation of a third choke valve to thereby regulate flow of the second fluid in the second production conduit.

5. The method of claim 1 wherein the control system is configured to reduce slug flow in the production conduit.

6. The method of claim 1 wherein the control system is configured to balance phase composition among a plurality of production conduits.

7. The method of claim 1 wherein a pressure differential between a pressure of the fluid at the well head and a pressure of the fluid at a riser is at least 2500 psi.

8. A method of controlling fluid flow in a plurality of oil/gas production conduits that are fluidly coupled to each other, comprising:

fluidly coupling a first choke valve to a first well head, and fluidly coupling a second choke valve to a second well head;

measuring flow of at least three phases of a fluid in a first and a second production conduit using first and second multiphase flow meters to produce first and second multiphase flow data;

wherein the three phases are selected from the group consisting of a hydrocarbon liquid, a hydrocarbon gas, water, and sand; and wherein the first and second multiphase flow data are representative of a flow rate of a specific phase in the fluid in the first and second production conduits, and wherein the multiphase flow data are representative of a phase composition of the fluid in the first and second production conduits;

using the second multiphase flow data in a control system to control operation of the first choke valve to thereby regulate fluid flow in the first production conduit.

9. The method of claim 8 further comprising a third and a fourth choke valve, wherein the third choke valve is in series with and downstream of the first choke valve, wherein the fourth choke valve is in series with and downstream of the second choke valve, and wherein operation of at least the third and fourth choke valves is controlled by the control system.

10. The method of claim 8 wherein at least one of the production conduits are selected from the group consisting of a wellhead conduit, a production tree conduit, a riser, a production flow line, and a subsea pipeline.

11. The method of claim 8 wherein the control system is configured to reduce slug flow in the production conduits.

12. The method of claim 8 wherein the control system is configured to balance phase composition among the plurality of production conduits.

13. An oil/gas production tree comprising:

a first choke valve that is connected to the production tree and that is fluidly coupled between a wellhead and a production conduit;

a multiphase flow meter coupled to the wellhead or the production tree and configured to measure flow of at least three phases flowing in the production conduit, wherein the three phases are selected from the group consisting of a hydrocarbon liquid, a hydrocarbon gas, water, and sand;

a second multiphase flow meter coupled to a second production conduit wherein the second production conduit is further coupled to a third choke valve;

a control system, wherein the control system is configured to (i) receive data obtained from the multiphase flow meter, (ii) control the first choke valve using data obtained from the multiphase flow meter, and (iii) allow control of the first and the third choke valve; and wherein the data from the multiphase flow meter are representative of a flow rate of a specific phase in a fluid moving in the wellhead or the production tree, and wherein the data from the multiphase flow meter are representative of a phase composition of the fluid in the wellhead or the production tree.

14. The production tree of claim 13 further comprising a second choke valve, wherein the second choke valve is in series and downstream of the first choke valve, and wherein the control system is further configured to allow control of the second choke valve.

15. The production tree of claim 13 wherein the production conduit is selected from the group consisting of a wellhead conduit, a production tree conduit, a production flow line, a riser, and a subsea pipeline.

16. The production tree of claim 13 wherein the control system is configured to reduce slug flow in the production conduit.

17. The production tree of claim 13 wherein the well head is a high-temperature high-pressure well head.

* * * * *